US005386351A

United States Patent [19]

Tabor

[11] Patent Number: 5,386,351

[45] Date of Patent: Jan. 31, 1995

[54] CONVENIENCE FLASHLIGHT

[75] Inventor: Marilyn Tabor, Cambridge, Mass.

[73] Assignee: Blue Tiger Corporation, Cambridge, Mass.

[21] Appl. No.: 196,418

[22] Filed: Feb. 15, 1994

[51] Int. Cl.[6] ..... F21L 7/00

[52] U.S. Cl. ..... 362/201; 362/200; 362/800

[58] Field of Search ..... 362/200, 201, 100, 800, 362/103, 188, 189, 191, ; 36/137, 136

[56] References Cited

U.S. PATENT DOCUMENTS

| | | | |
|---|---|---|---|
| Re. 14,088 | 3/1916 | Koretsky | 362/206 |
| 1,866,600 | 7/1932 | Rauch | 362/189 |
| 3,359,411 | 12/1967 | Schwartz | 362/189 |
| 3,613,414 | 10/1971 | Ostrager | 362/116 |
| 4,101,955 | 7/1978 | DuNah | 362/104 |
| 4,210,953 | 7/1980 | Stone | 362/189 |
| 4,392,186 | 7/1983 | Cziment | 362/116 |
| 4,399,495 | 8/1983 | Leopoldi et al. | 362/189 |
| 4,408,261 | 10/1983 | Polakoff | 362/104 |
| 4,433,365 | 2/1984 | Rousseau | 362/189 |
| 4,521,833 | 6/1985 | Wolter | 362/116 |
| 4,692,846 | 9/1987 | Johnson | 362/104 |
| 4,745,527 | 5/1988 | Belverio, Jr. et al. | 362/100 |
| 4,768,138 | 8/1988 | Leopoldi et al. | 362/189 |
| 4,774,643 | 9/1988 | McGinnis et al. | 362/189 |
| 4,893,222 | 1/1990 | Mintzer | 362/109 |
| 5,029,055 | 7/1991 | Lindh | 362/191 |
| 5,043,854 | 8/1991 | Gammache | 362/197 |
| 5,158,356 | 10/1992 | Guthrie | 362/200 X |
| 5,285,586 | 2/1994 | Goldston et al. | 36/136 X |
| 5,303,131 | 4/1994 | Wu | 362/200 X |

FOREIGN PATENT DOCUMENTS

| | | | |
|---|---|---|---|
| 1058466 | 2/1967 | United Kingdom | 362/200 |

*Primary Examiner*—Ira S. Lazarus
*Assistant Examiner*—Thomas M. Sember
*Attorney, Agent, or Firm*—Lahive & Cockfield

[57] ABSTRACT

A flashlight consists of a bulb with leads, a battery of flat, disc shape and three molded plastic parts. Assembly is accomplished without tools by slip fitting two of said parts together to form a case, the third part serving as a push button.

6 Claims, 2 Drawing Sheets

CONVENIENCE FLASHLIGHT

BACKGROUND OF THE INVENTION

This invention relates generally to convenience flashlights for localized illumination in a darkened environment. More particularly, it relates to momentary push button flashlights of simplified, inexpensive construction.

Convenience lights of this type are useful for a variety of applications including illumination of hand held remote control devices in darkened rooms, illumination of key holes in darkened entrances, and illumination of darkened areas and small recesses generally. The lights hitherto employed for these purposes are of a great variety, and in general they achieve the principal object of providing illumination. However, the structures employed frequently consist of an excessive number of parts, are unduly expensive to fabricate, fail to operate reliably or in a convenient manner, or possess some combination of these and other disadvantages.

A principal object of this invention is to provide a flashlight consisting of a minimum number of pans.

A second object is to permit the pans to be assembled readily without tools.

A third object is to provide parts that are formed to retain the elements firmly in accurately predetermined relationship, whereby a sturdy structure and dependable performance are achieved.

With these and other objects hereinafter appearing in view, this invention comprises a thin flashlight consisting of five pans, namely, a bulb with extending leads, a battery of flat disc shape and three molded plastic parts. The flashlight is assembled by slip-fitting two of the plastic parts together to form a thin, flat case, the third part serving as a push button retained in the case.

The case comprises a body and a cover, the body being formed to provide a seat for the battery, and the cover having an aperture opposing the battery. The push button extends through the aperture and is resiliently movable toward and away from the battery.

The push button comprises a first potion extending through the aperture, a second potion forming an abutment with the cover to limit movement away from the body, and a third potion resiliently engaging the battery at all times. Resilient properties of the bulb leads are utilized to open the battery circuit when the push button is released and abuts the cover. The circuit is closed by pushing the button against the resilient forces of said leads and said third portion.

DRAWINGS

DETAILED DESCRIPTION OF THE DRAWINGS

Figure 2:
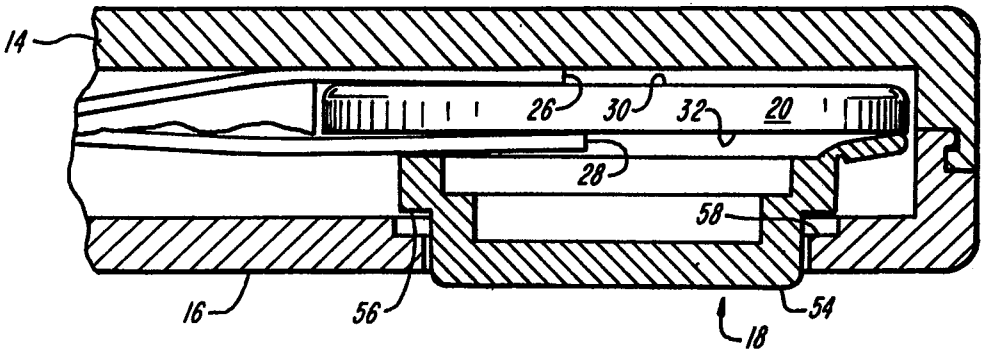
FIG. 2 is a fragmentary elevation in section corresponding to FIG. 1 showing the movable parts in the closed circuit position.

The presently preferred embodiment of the invention is a flashlight generally shown at 12 comprising a case

13 having a case body 14 and a case cover 16, a push button 18, a battery 20 of conventional disc shape, and a light bulb 22 of conventional form, preferably a light emitting diode 24 with a pair of elongate leads 26 and 28. The leads are metallic, of malleable form, and possess resilient, springlike properties with respect to deflections in directions lateral to their major extent. Major portions of the opposing faces of the battery 20 comprise terminals 30 and 32.

The case body 14 is a unitary body of molded resilient polymeric composition. A flat front wall 34 of the body has three lead-retaining, mutually spaced, parallel ribs 36 and two parallel battery locating ribs 38 projecting inwardly from it. The body also has a closed sidewall 40 and a light hood 42.

The case cover is a unitary body of molded resilient polymeric composition. It comprises a back wall 44 having an aperture 46, a sidewall 48, an integral bulb retaining post 50 extending inwardly from the wall 44, and battery retaining projections 52 extending from the sidewall 48.

The push button 18 is a unitary body of molded resilient polymeric composition. It comprises three principal portions, namely, a circular first portion 54 adapted to fit within the aperture 46, a second portion comprising an annular shoulder 56 adapted to fit within and to abut an annular recess 58 in the cover (FIG. 2), and a plurality of legs 60 extending at inclines radially outwardly and away from the first portion. The legs are of resilient form, and are angularly separated by a uniform angle, shown as 120°.

To assemble the flashlight, the leads 26 and 28 of the bulb are first bent in relation to the body of the diode 24, extended in a generally parallel manner, and bent slightly apart so that when in the unstressed condition their end portions are spaced apart by a distance greater than the thickness of the battery 20. The bulb is fitted in a socket 62 formed by surfaces of the base 14, with the leads respectively extending between and separated by pairs of the ribs 36. The battery is inserted into the base 14 in position to rest on the locating ribs 38 with the lead 26 fitted between the wall 34 of the base and the terminal 30 of the battery.

With the push button 18 loosely held in the aperture 46 of the cover, the cover is slip-fitted and snapped onto the base 14. The case 13 is held in assembled condition by matching circumferential grooves and shoulders 64 molded in the body and cover, formed to provide a snap fit. If desired, a pry slot may be formed in an edge of the case to assist in disassembly.

Figure 1:
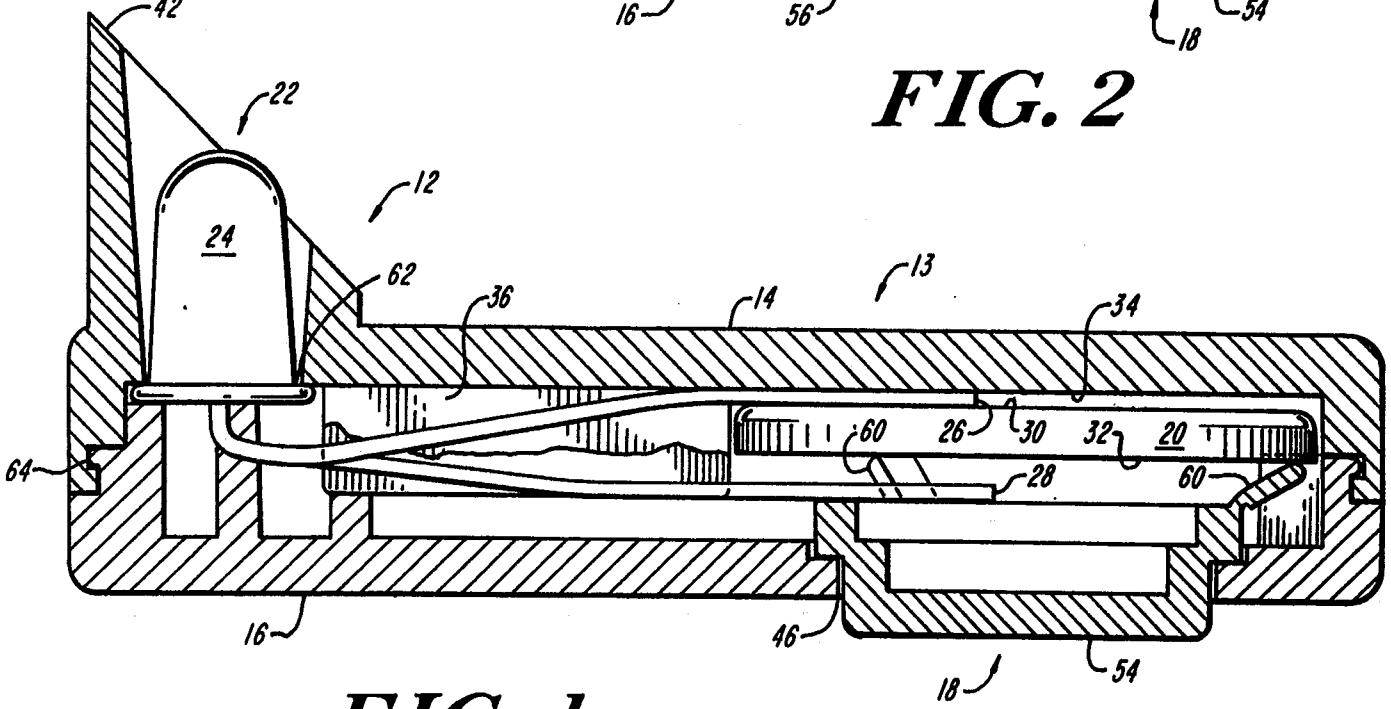
FIG. 1 is a side elevation in section of the assembled flashlight in the normal, open circuit position.
Figure 3:
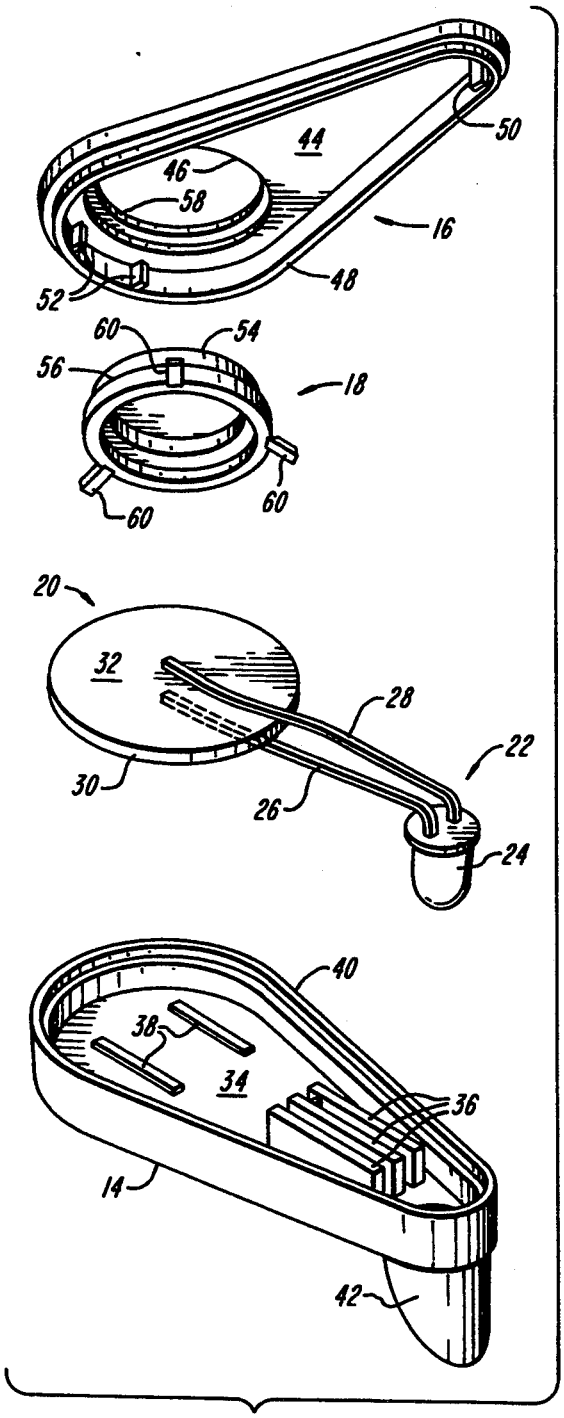
FIG. 3 is an exploded view showing the unassembled elements of the flashlight.
Figure 4:
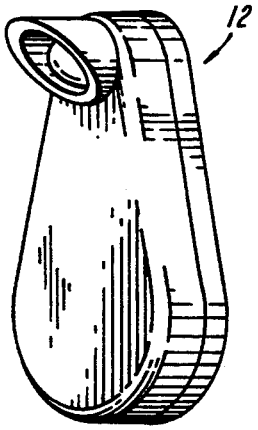
FIG. 4 is a front and side perspective view of the assembled flashlight.
Figure 5:
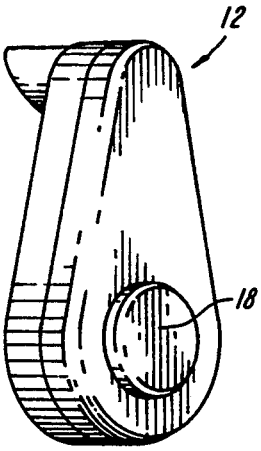
FIG. 5 is a back and side perspective view of the assembled flashlight.

When the case is fully assembled as shown in FIGS. 1, 4 and 5, when the pushbutton is in the normal, undepressed position the legs 60 bear upon the terminal 32 of the battery with sufficient pressure to cause the shoulder 56 of the push button to bear upon the groove 58 in the cover. This pressure also forces the terminal 30 of the battery against it seat on the locating ribs 38 and into electrical contact with the lead 26. This allows the lead 28 to move out of contact with the terminal 32. When the push button is depressed, it pushes the lead 28 against the terminal 32, thereby completing the electrical circuit to the bulb 22.

The flashlight may be moved about without causing the respective parts to be jarred out of alignment. The legs 60 of the pushbutton remain deflected in both the on and off positions, constantly holding the battery infirm seated position on the ribs 38. The post 50 and the projections 52 on the cover firmly hold the bulb and battery in proper position and alignment within the case, respectively.

For a variety of uses including remote control devices, it is convenient to provide hook and loop fastener pieces (not shown) that can be applied by contact adhesive either to the external surface of the front wall 34 of the base or to the exposed surface of the push button, complementary hook or loop pieces being applied to external objects to which the flashlight may be adhered.

The hood 42 is shaped to provide appropriate illumination for use when the flashlight is mounted on a hand held remote control. If desired, it may be shaped in any other convenient manner for other applications.

The flashlight is of very low cost because two of the components, namely, the bulb and battery, are employed in commercially available form, and the other three components are each of integral molded plastic form. The five elements may be assembled together without special skill or tools. Thus, the only substantial cost is that associated with the molding of the three plastic parts.

I claim:

1. A flashlight comprising, in combination, a battery having a pair of flat, mutually parallel terminals of opposite polarity, a light bulb having a pair of spaced elongate leads extending generally parallel to the terminals, end portions of the leads being located adjacent and respectively opposing the terminals, said leads being resilient in a direction normal to the terminals and being spaced further apart than the terminals when in an unstressed condition, a case body having a socket for the bulb and a seat for one terminal of the battery, a case cover slip fitted to the case body and having an aperture spaced from and opposing the other terminal of the battery, and a push button having first, second and third portions mutually connected for simultaneous movement in said direction, said first portion extending outwardly of the case cover through the aperture, said second portion formed to abut the case cover to limit movement of the button away from the case body, and said third portion resiliently engaging said other terminal, said third portion being adapted to force said one terminal in said direction against said seat and into electrical contact with one lead when said second portion abuts the case cover, said button being formed to engage said other lead and to force it into electrical contact with said other terminal when said first portion is depressed toward the case body.

2. The combination of claim 1, in which the button consists of a unitary body of resilient polymeric composition.

3. The combination of claim 2, in which said third portion comprises a plurality of legs each having resilient engagement with said other terminal.

4. The combination of claim 1, in which the case body has a plurality of ribs confining the leads in mutually spaced, insulated and parallel relationship over a substantial portion of their extent.

5. The combination of claim 3, in which the case body consists of a unitary body of polymeric composition having a plurality of integral ribs located to confine the leads in mutually spaced, insulated and parallel relationship and to permit relative movement thereof in said direction.

6. The combination of claim 3, in which the battery is of flat, disc shape.

* * * * *

UNITED STATES PATENT AND TRADEMARK OFFICE

CERTIFICATE OF CORRECTION

PATENT NO. : 5,386,351

DATED : January 31, 1995

INVENTOR(S) : Marilyn Tabor

It is certified that error appears in the above-identified patent and that said Letters Patent is hereby corrected as shown below:

Column 1, lines 23, 24 and 32, cancel "pans" and substitute --parts--

Column 2, line 58, cancel "it" and substitute --its--; line 68, cancel "infirm" and substitute --in firm--

Signed and Sealed this

Eleventh Day of April, 1995

Bruce Lehman

*Attest:*

BRUCE LEHMAN

*Attesting Officer*

*Commissioner of Patents and Trademarks*